US005131983A

United States Patent [19]

Pulkowski et al.

[11] Patent Number: 5,131,983

[45] Date of Patent: Jul. 21, 1992

[54] HEATED PRESS APPARATUS WITH ELASTOMERIC COVERED ROLL(S)

[75] Inventors: Jeffrey H. Pulkowski, Beloit, Wis.; Robert J. Orange, Bloomington, Minn.

[73] Assignee: Beloit Corporation, Beloit, Wis.

[21] Appl. No.: 740,677

[22] Filed: Aug. 6, 1991

[51] Int. Cl.[5] ..... D21F 3/02

[52] U.S. Cl. ..... 162/358.5; 162/206; 162/375

[58] Field of Search ..... 162/205, 206, 358, 359, 162/361, 375

[56] References Cited

U.S. PATENT DOCUMENTS

| | | | |
|---|---|---|---|
| 2,114,072 | 4/1938 | Cleveland | 162/358 |
| 3,269,893 | 8/1966 | Rojecki | 162/358 |
| 3,293,121 | 12/1966 | Martin | 162/358 |
| 3,586,602 | 6/1971 | Schmidt | 162/359 |
| 3,798,121 | 3/1974 | Busker et al. | 162/358 |
| 3,804,707 | 4/1974 | Mohr et al. | 162/358 |
| 4,324,613 | 4/1982 | Wahren | 162/206 |
| 4,484,982 | 11/1984 | Majaniemi | 162/358 |
| 4,559,106 | 12/1985 | Skyttä et al. | 162/358 |
| 4,691,449 | 9/1987 | Wiberg | 162/360.1 |
| 4,738,752 | 4/1988 | Busker et al. | 162/358 |
| 4,874,469 | 10/1989 | Pulkowski et al. | 162/358 |
| 4,976,820 | 11/1990 | Laapotti | 162/358 |

*Primary Examiner*—Karen M. Hastings

*Attorney, Agent, or Firm*—Dirk J. Veneman; Raymond W. Campbell; David J. Archer

[57] ABSTRACT

A press apparatus and method for pressing water from a paper web is disclosed. The apparatus includes a frame and a first press roll which is rotatably supported by the frame. A second press roll cooperates with the first roll for defining therebetween a pressing nip such that in use of the apparatus, the web extends through the nip for pressing the water therefrom. An elastomeric cover covers at least one of the rolls such that the pressing nip is extended in a machine direction so that the residence time of the web during passage of the web through the nip is increased.

11 Claims, 4 Drawing Sheets

HEATED PRESS APPARATUS WITH ELASTOMERIC COVERED ROLL(S)

BACKGROUND OF THE INVENTION

1. Field of the Invention

The present invention relates to a press apparatus and method for pressing water from a paper web. More particularly, the present invention relates to an extended nip press for pressing water from a paper web.

2. Information Disclosure Statement

In the papermaking art, a web of paper is formed by ejecting stock onto a moving screen such that water is drained through the screen so that a fibrous web is formed thereon. The fibrous web is removed from the screen and is guided through at least one pair of counter- rotating rolls for pressing excess water from the formed web.

More recently, it was discovered that by increasing the residence time of the web within the pressing section, more water could be removed from the formed web, thereby reducing the amount of thermal energy required in any subsequent drying section. Accordingly, such proposals generally include a rotatable backing roll and a cooperating shoe defining a concave surface for cooperation with the backing roll to define therebetween an extended nip.

In order to enable the formed web to extend through the extended nip, the aforementioned extended nip press includes an endless looped bearing blanket which slidably cooperates with the concave surface of the shoe so that the web and blanket extend through the extended pressing section, thereby increasing the residence time of the web within the pressing section.

Not only is the residence time of the web within the pressing section increased, but also the web is subjected to a less severe increase in pressure during passage of the web through the extended nip. Accordingly, the extended nip press not only increases the amount of water removed from the formed web, but also enhances the properties of the resultant web.

However, although the aforementioned extended nip press concept is comparatively straight-forward, the production of a commercially feasible extended nip press involves considerable technological problems and the expenses associated therewith.

Accordingly, the present invention provides an apparatus for increasing the residence time of the formed web during passage through a pressing nip while avoiding the complexities associated with the aforementioned extended nip press arrangements.

The present invention provides a press apparatus which includes a pair of press rolls, at least one of which rolls is covered with an elastomeric covering such that the pressing nip is extended in a machine direction so that the residence time of the web during passage of the web through the nip is increased.

Therefore, it is a primary objective of the present invention to provide a press apparatus and method which overcomes the aforementioned inadequacies of the prior art arrangements and which makes a considerable contribution to the art of pressing water from a paper web.

Another object of the present invention is the provision of a press apparatus having a first press roll having a concentric cover and heating means for conducting heat to the web such that the web is subjected to increased pressure and temperature for an extended period.

Another object of the present invention is the provision of a press apparatus in which the uncovered press roll defines a porous outer surface which is heated.

Another object of the present invention is the provision of a press apparatus in which at least one of the press rolls is covered with an elastomeric cover and wherein the web is heated by means of a heat conductive belt such that the belt conducts heat to the web during movement of the web and the belt through the pressing nip.

Another object of the present invention is the provision of a press apparatus which includes an elastomeric blanket defining an endless loop, the blanket extending through an extended nip defined between a pair of rolls, at least one of which is covered with an elastomeric cover such that the residence time within the pressing nip is further increased.

Another object of the present invention is the provision of a press apparatus which includes a guiding means for guiding an elastomeric blanket such that the blanket and web wrap around a portion of a porous outer surface of one of the press rolls in order to adjust the pressure profile of the web exiting the pressing nip.

Another object of the present invention is the provision of a press apparatus including insulating means for inhibiting the conduction of heat from a heating means to an elastomeric cover covering at least one press roll.

Other objects and advantages of the present invention will be readily apparent to those skilled in the art by a consideration of the detailed description contained hereinafter taken in conjunction with the annexed drawings.

SUMMARY OF THE INVENTION

The present invention relates to a press apparatus and method for pressing water from a paper web. The apparatus includes a frame and a first press roll which is rotatably supported by the frame. A second press roll cooperates with the first press roll for defining therebetween a pressing nip such that in use of the apparatus, the web extends through the nip for pressing water therefrom. An elastomeric cover covers at least one of the rolls such that the pressing nip is extended in a machine direction so that the residence time of the web during passage of the web through the nip is increased.

In a more specific embodiment of the present invention, the first press roll is covered with a cover such that the cover is disposed concentrically relative to the first press roll. Additionally, the apparatus includes heating means for conducting heat to the web such that during movement of the web through the pressing nip, the web is subjected to increased temperature and pressure for an extended period. The arrangement is such that a substantial portion of the water within the web is removed in the liquid phase. Also, the second press roll defines a porous outer surface such that during use of the apparatus, the water in the liquid phase and the water in the vapor phase are absorbed by the porous outer surface so that delamination of the web is inhibited.

In one embodiment of the present invention, the heating means is disposed closely adjacent to the second press roll for heating a porous outer surface of the second press roll. The arrangement is such that heat is conducted from the porous outer surface to the web during movement of the web through the pressing nip.

In a preferred embodiment of the present invention, the heating means is an induction heater.

In an alternative embodiment of the present invention, the heating means includes a heat conductive belt which defines an endless loop. The belt extends through the pressing nip such that heat is conducted from the belt to the web during movement of the web and the belt through the pressing nip. Also, a heater is disposed closely adjacent to the belt and upstream relative to the pressing nip for heating the belt.

More specifically, the heated belt is metallic and includes water absorbing fibers.

In a further embodiment of the present invention, the press apparatus includes an elastomeric blanket which defines an endless loop. The blanket extends through the pressing nip such that the web is disposed between the blanket and the second press roll such that the blanket further softens the pressing nip defined between the blanket and the second press roll so that the residence time of the web during passage of the web through the pressing nip is further increased.

In another embodiment of the present invention, a press apparatus further includes guiding means disposed downstream relative to a pressing nip. The guiding means is disposed nearer to the second press roll than to the first press roll such that the blanket and the web wrap around a portion of a porous outer surface of the second press roll downstream relative to the pressing nip so that adjustment of the pressure profile of the web exiting the pressing nip is controlled. The arrangement is such that any tendency of the web to delaminate is further alleviated. The arrangement also assists dewatering of the web and facilitates release of the web from the porous outer surface of the press roll so that the properties of the resultant pressed web are enhanced.

In a further alternative embodiment of the present invention, a guide means similar to the aforementioned guiding means is disposed upstream relative to the pressing nip. The guide means is disposed nearer to the second press roll than to the first press roll such that a blanket and the web wrap around a portion of the porous outer surface of the second press roll upstream relative to the pressing nip so that adjustment of the pressure profile of the web entering the pressing nip is controlled. The arrangement is such that any tendency of the web to delaminate is further alleviated. Furthermore, the arrangement assists dewatering of the web and facilitates release of the web from the porous outer surface of the press roll so that the properties of the resultant pressed web are enhanced.

In yet another embodiment of the present invention, a press apparatus includes an insulating means which extends through a pressing nip. The insulating means is disposed as an endless loop between the cover and the web for inhibiting the conduction of heat from the heating means to the elastomeric cover.

In a preferred embodiment of the present invention, the first press roll, which is covered, has a larger diameter than the diameter of the second press roll.

In an alternative embodiment of the present invention, a press apparatus includes a frame and a first press roll rotatably supported by the frame. A second press roll cooperates with the first press roll for defining therebetween a pressing nip such that in use of the apparatus, the web extends through the nip for pressing water therefrom. An elastomeric cover covers at least one of the rolls such that the pressing nip is extended in a machine direction so that the residence time of the web during passage of the web through the nip is increased. The first press roll is covered with a cover such that the cover is disposed concentrically relative to the first press roll. Heating means is provided for conducting heat to the web such that during movement of the web through the pressing nip, the web is subjected to increased temperature and pressure for an extended period such that a substantial portion of the water within the web is removed in the liquid phase. The second press roll defines a porous outer surface such that during use of the apparatus, the water in the liquid phase and the water in the vapor phase are absorbed by the porous outer surface so that delamination of the web is inhibited.

Additionally, some of the water in the liquid phase is also absorbed and transported away from the pressing nip by a press felt.

The heating means specifically includes a heat conductive belt which defines an endless loop. The belt extends through the pressing nip such that heat is conducted from the belt to a first side of the web during movement of the web and the belt through the pressing nip. The heating means also includes a heater which is disposed closely adjacent to the belt and upstream relative to the pressing nip for heating the belt. Additionally, the heating means includes a further heater disposed closely adjacent to the porous outer surface for heating the surface such that heat is conducted from the porous outer surface to a second side of the web during passage of the web and the belt through the pressing nip.

In another embodiment of the present invention, a press apparatus includes a frame and a first press roll rotatably supported by the frame. A second press roll cooperates with the first press roll for defining therebetween a pressing nip such that in use of the apparatus, the web extends through the nip for pressing water therefrom. A first elastomeric cover covers the first press roll such that the pressing nip is extended in a machine direction so that the residence time of the web during passage of the web through the nip is increased.

A second elastomeric cover covers the second press roll such that the pressing nip is extended in a machine direction so that the residence time of the web during passage of the web through the nip is increased. Heating means conducts heat to the web such that during movement of the web through the pressing nip, the web is subjected to increased temperature and pressure for an extended period such that a substantial portion of water within the web is removed in the liquid phase.

The heating means includes the combination of a first heat conductive belt which defines an endless loop. The first belt extends through the pressing nip such that heat is conducted from the first belt to the web for heating a first side of the web during movement of the web and the first belt through the pressing nip. A first heater is disposed closely adjacent to the first belt and upstream relative to the pressing nip for heating the first belt. A second heat conductive belt defines an endless loop. The second belt extends through the pressing nip such that heat is conducted from the second belt to the web for heating a second side of the web during movement of the web and the belt through the pressing nip. The web is disposed between the first and the second belts. A second heater is disposed closely adjacent to the second belt and upstream relative to the pressing nip for heating the second belt.

The present invention also includes a method of pressing water from a paper web. The method includes the steps of moving the web through a pressing nip defined between a first and a second press roll rotatably supported by a frame, the first press roll being covered with an elastomeric cover and the second press roll defining a porous outer layer.

The porous outer layer of the second press roll is heated such that heat is conducted from the porous outer layer to the web during movement of the web through the pressing nip. The arrangement is such that the web is subjected to increased temperature and pressure for an extended period during movement of the web through the pressing nip so that a substantial portion of the water within the web is removed in the liquid phase. The water in the liquid phase and the water in the vapor phase are then absorbed by the porous outer surface so that delamination of the resultant web is inhibited.

Many modifications and variations of the present invention will be readily apparent to those skilled in the art by a consideration of the detailed description contained hereinafter taken in conjunction with the annexed drawings. However, such variations and modifications fall within the spirit and scope of the present invention as defined by the appended claims.

BRIEF DESCRIPTION OF THE DRAWINGS

Similar reference characters refer to similar parts throughout the various embodiments shown in the drawings.

DETAILED DESCRIPTION OF THE DRAWINGS

Figure 1:
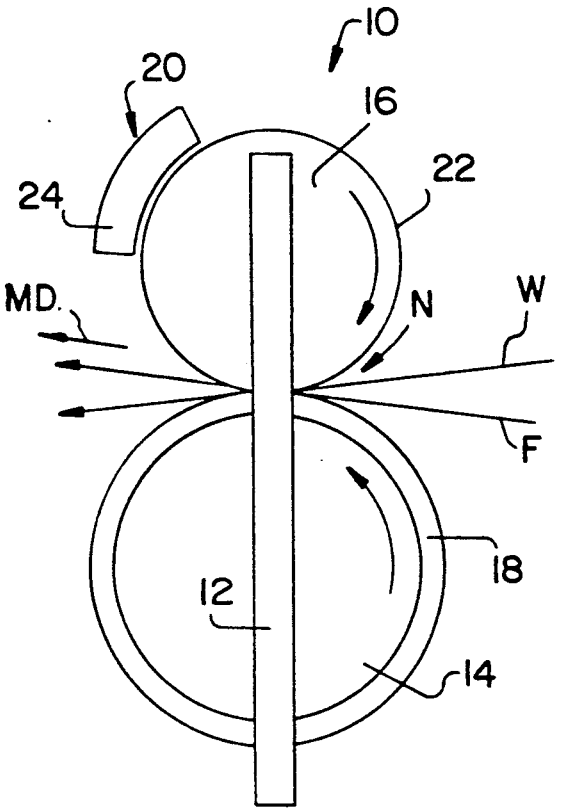
FIG. 1 is a side-elevational view of a press apparatus according to a first embodiment of the present invention.

FIG. 1 shows a press apparatus generally designated 10 for pressing water from a paper web W. The apparatus 10 includes a frame 12 and a first press roll 14 rotatably supported by the frame 12. A second press roll 16 cooperates with the first press roll 14 for defining therebetween a pressing nip N such that in use of the apparatus 10, the web W extends together with a press felt F through the nip N for pressing the water therefrom.

An elastomeric cover 18 covers the roll 14 such that the pressing nip N is extended in a machine direction as indicated by the arrow MD so that the residence time of the web W during passage of the web W through the nip N is increased.

More specifically, FIG. 1 shows the press apparatus with the first press roll 14 covered with the cover 18 such that the cover 18 encompasses and is disposed generally concentrically relative to the first press roll 14.

Heating means generally designated 20 heats the roll 16 which, in turn, heats the web W such that during movement of the web W through the pressing nip N, the web W is subjected to increased temperature and pressure for an extended period such that a substantial portion of the water within the web W is removed in the liquid phase into a felt F which extends with the web W through the nip N.

The second press roll 16 defines a porous outer surface 22 such that during use of the apparatus 10, the water in the liquid phase and the water in the vapor phase are absorbed by the porous outer surface 22 so that delamination of the web W is inhibited.

More specifically, FIG. 1 shows the heating means 20 is disposed closely adjacent to the second press roll 16 for heating the porous outer surface 22 of the second press roll 16 such that heat is conducted from the porous outer surface 22 to the web W during movement of the web W through the pressing nip N.

In a specific embodiment of the present invention, the heating means 20 is an induction heater 24. The heater may be a gas fired burner or an electric infrared heater.

Figure 2:
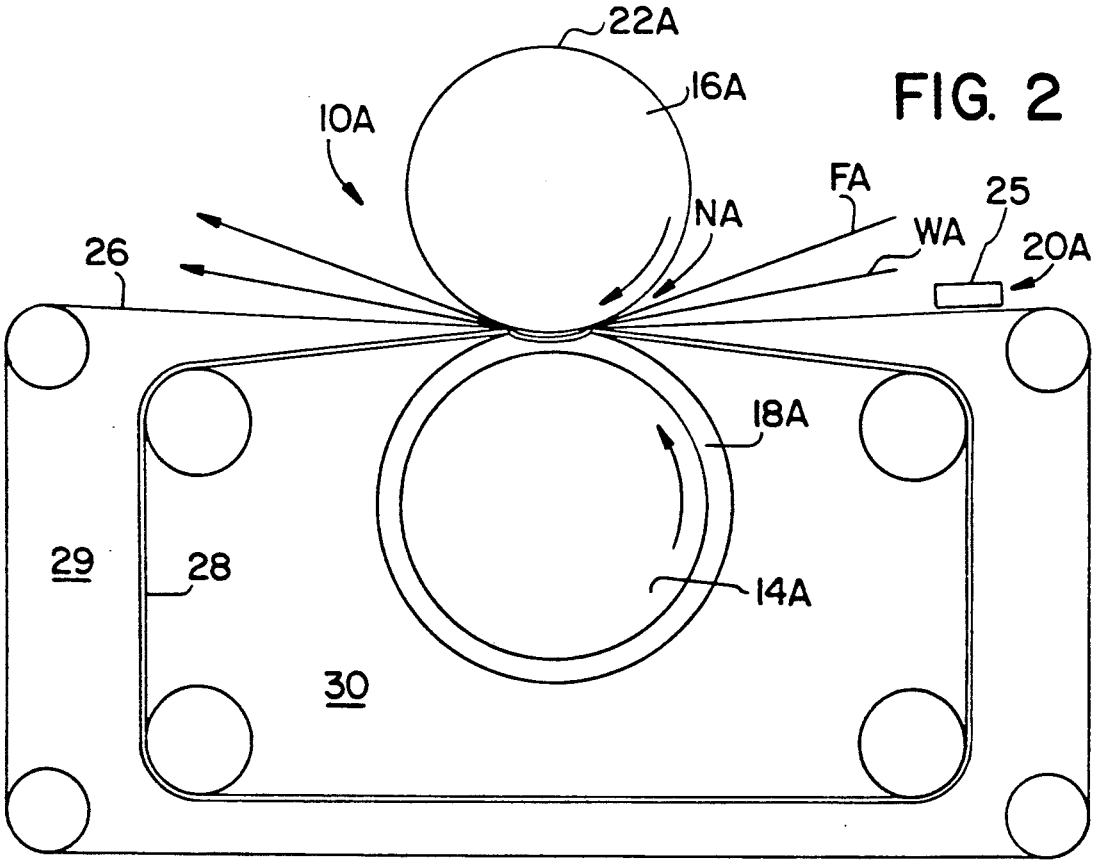
FIG. 2 is a side-elevational view of a second embodiment of the present invention.

In another embodiment of the present invention, as shown in FIG. 2, a press apparatus 10A includes heating means generally designated 20A which includes a heat conductive belt 26 defining an endless loop 29. The belt 26 extends through a pressing nip NA such that heat is conducted from the belt 26 to the web WA during movement of the web WA and a felt FA and the belt 26 through the pressing nip NA.

A heater 25 is disposed closely adjacent to the belt 26 and upstream relative to the pressing nip NA for heating the belt 26. The web WA is disposed between the belt 26 and the felt FA with the felt contacting the surface 22A of the roll 16A.

More specifically, the heated belt 26 is metallic, the metallic belt 26 including water absorbing fibers.

As shown in FIG. 2, the press apparatus 10A further includes an elastomeric blanket 28 defining an endless loop 30. The blanket 28 extends through the pressing nip NA such that the web WA is disposed between the blanket 28 and the second press roll 16A such that the blanket 28 further softens the pressing nip NA defined between the blanket 28 and the second press roll 16A so that the residence time of the web WA during passage of the web through the pressing nip NA is further increased.

Figure 2A:
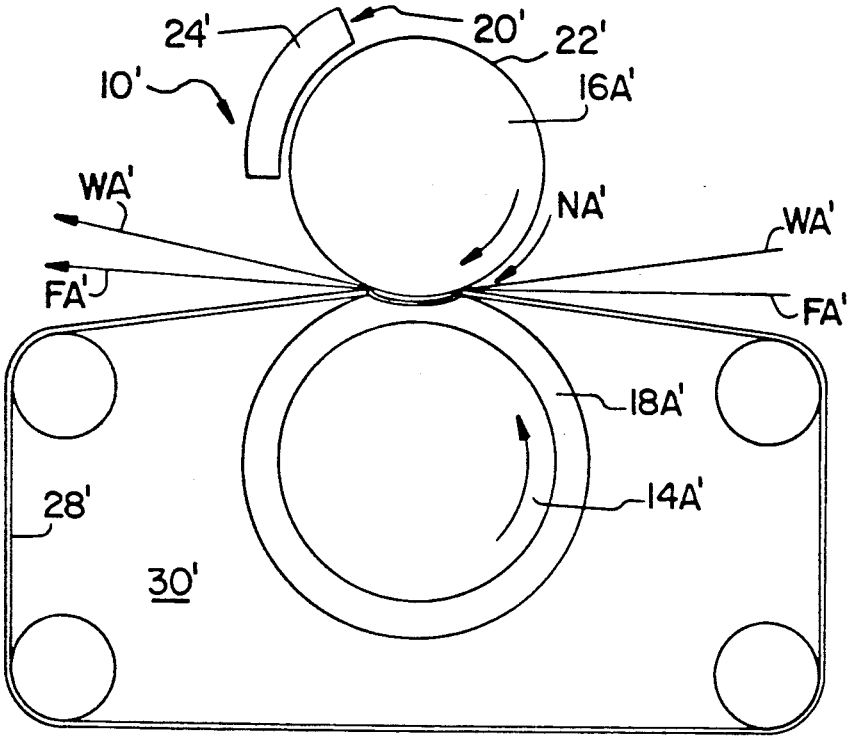
FIG. 2A is a side-elevational view of a variation of the embodiment shown in FIG. 2.

FIG. 2A shows a modification of the arrangement shown in FIG. 2. FIG. 2A shows the heated belt 26 removed and replaced by an induction heater 24' disposed adjacent to the second press roll 16A'.

Apart from this, the arrangement of FIG. 2A is the same as that shown in FIG. 2, and the felt FA' is disposed between the web WA' and the elastomeric blanket 28'.

Figure 3:
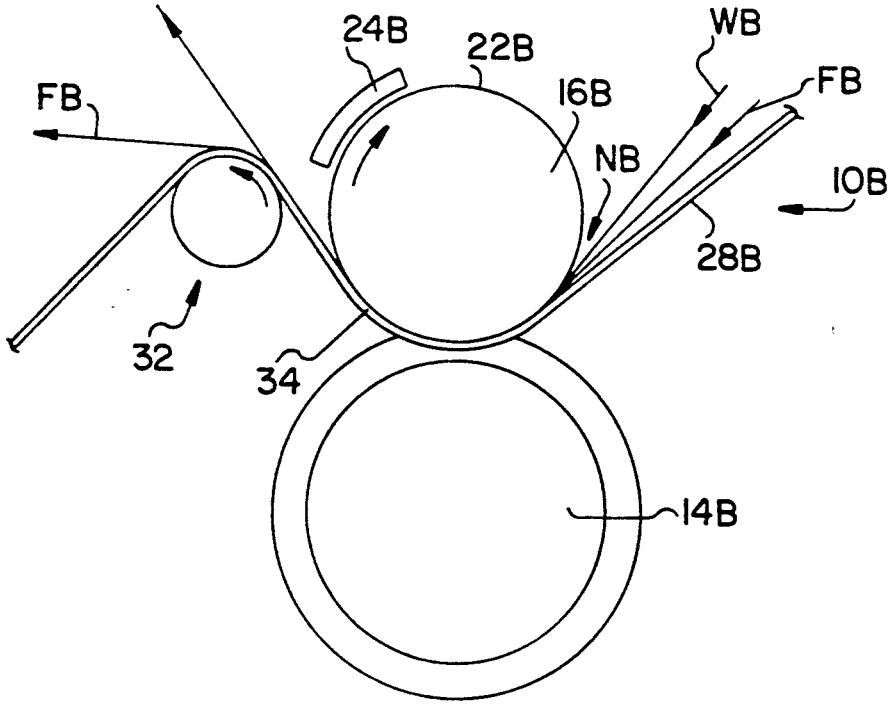
FIG. 3 is a side-elevational view of a third embodiment of the present invention.

FIG. 3 is an elevational view of a further embodiment of the present invention in which a press apparatus 10B includes guiding means generally designated 32 disposed downstream relative to a pressing nip NB. The guiding means 32 is disposed nearer to a second press roll 16B than to a first press roll 14B such that a blanket 28B, the web WB and a felt FB wrap around a portion 34 of the porous outer surface 22B of the second press roll 16B downstream relative to the pressing nip NB so that adjustment of the pressure profile of the web W exiting the pressing nip NB is controlled. The arrangement is such that any tendency of the web WB to delaminate is further alleviated. The arrangement also assists dewatering of the web WB and facilitates release of the web WB from the porous outer surface 22B of the press roll 16B so that the properties of the resultant pressed web WB are enhanced.

Figure 4:
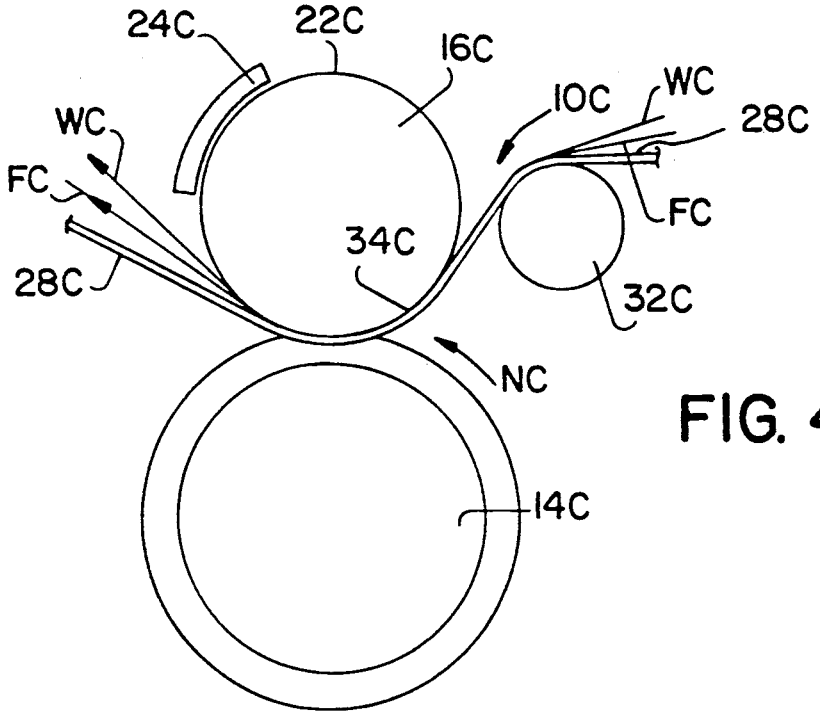
FIG. 4 is a side-elevational view of a fourth embodiment of the present invention.

FIG. 4 is an elevational view of a further embodiment of the present invention which is similar in certain respects to that shown in FIG. 3. A press apparatus 10C includes guide means 32C disposed upstream relative to a pressing nip NC. The guide means 32C is disposed nearer to the second press roll 16C than to the first press roll 14C such that a blanket 28C and the web WC wrap around a portion 34C of a porous outer surface 22C of the second press roll 16C upstream relative to the pressing nip NC so that adjustment of the pressure profile of the web WC entering the pressing nip NC is controlled. The arrangement is such that any tendency of the web WC to delaminate is further alleviated. Additionally, the arrangement assists dewatering of the web WC and facilitates release of the web WC from the porous outer surface 22C of the press roll 16C so that the properties of the resultant pressed web WC are enhanced. Also, a felt FC is disposed between the web WC and the blanket 28C.

Figure 5:
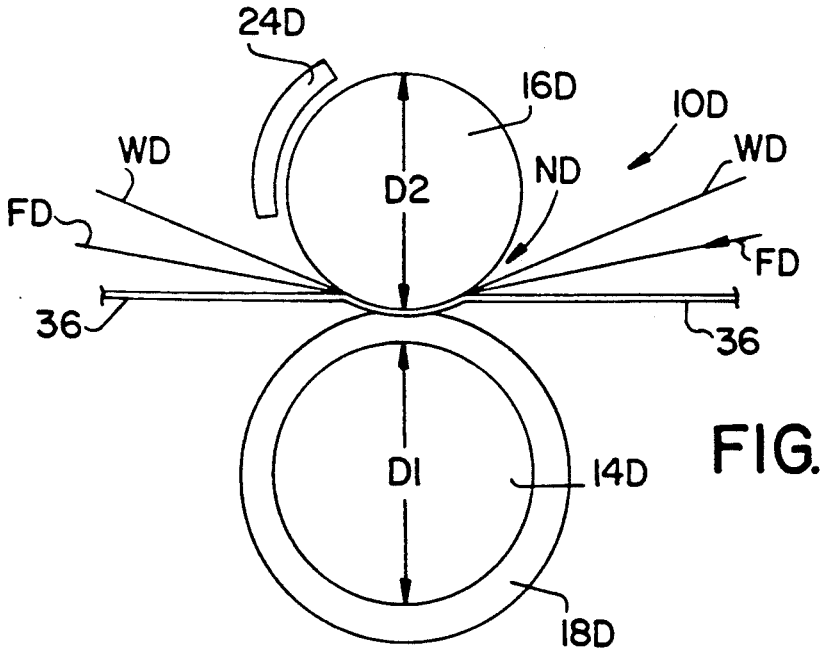
FIG. 5 is a side-elevational view of a fifth embodiment of the present invention.

FIG. 5 is an elevational view of a further embodiment of the present invention in which a press apparatus 10D includes an insulating means 36. The insulating means 36 extends through a pressing nip ND such that the insulating means 36 is disposed between a cover 18D and the web WD for inhibiting the conduction of heat from a heating means 24D to the elastomeric cover 18D. Also, a felt FD is disposed between insulating means 36 and the web WD.

In the preferred embodiment of the present invention, as shown in FIG. 5, the first press roll 14D, which is covered with cover 18D, has a larger diameter D1 than the diameter D2 of the second press roll 16D.

Figure 6:
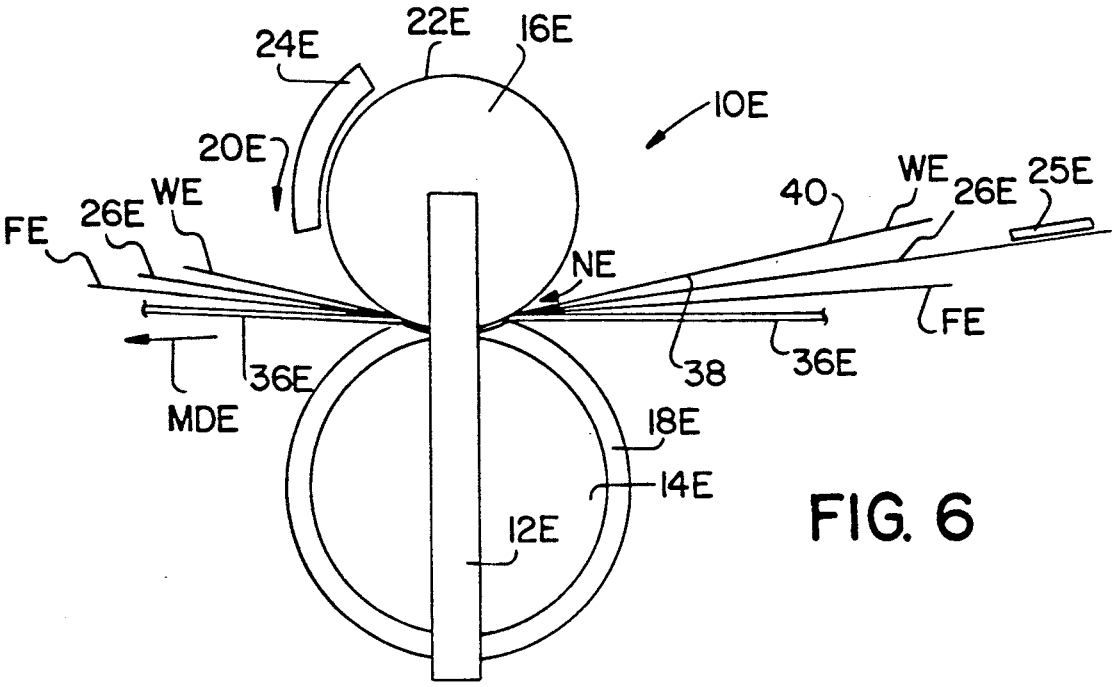
FIG. 6 is a side-elevational view of a sixth embodiment of the present invention.

FIG. 6 is a side-elevational view of yet another embodiment of the present invention in which a press apparatus 10E presses water from a paper web WE. The apparatus 10E includes a frame 12E and a first press roll 14E rotatably supported by the frame 12E. A second press roll 16E cooperates with the first press roll 14E for defining therebetween a pressing nip NE such that in use of the apparatus 10E, the web WE extends through the nip NE for pressing water therefrom.

An elastomeric cover 18E covers the roll 14E such that the pressing nip NE is extended in a machine direction, as indicated by the arrow MDE, so that the residence time of the web WE during passage of the web WE through the nip NE is increased.

The first press roll 14E is covered with the cover 18E such that the cover 18E is disposed generally concentrically relative to the first press roll 14E. Heating means generally designated 20E are provided for conducting heat to the web WE such that during movement of the web WE through the pressing nip NE, the web WE is subjected to increased temperature and pressure for an extended period such that a substantial portion of the water within the web WE is removed in the liquid phase.

The second press roll 16E defines a porous outer surface 22E such that during use of the apparatus 10E, the water in the liquid phase and the water in the vapor phase are absorbed by the porous outer surface 22E so that delamination of the web WE is inhibited.

The heating means 20E includes a heat conductive belt 26E which defines an endless loop. The belt 26E extends through the pressing nip NE such that heat is conducted from the belt 26E to a first side 38 of the web WE during movement of the web WE and the belt 26E through the pressing nip NE.

A heater 25E is disposed closely adjacent to the belt 26E and upstream relative to the pressing nip NE for heating the belt 26E. Also, a further heater 24E is disposed closely adjacent to the porous outer surface 22E for heating the surface 22E such that heat is conducted from the porous outer surface 22E to a second side 40 of the web during passage of the web WE and the belt 26E through the pressing nip NE.

Additionally, as shown in FIG. 6, an insulating means 36E is disposed between the elastomeric cover 18E and the heat conductive belt 26E, and a felt FE is disposed between the insulating means 36E and the heat conductive belt 26E for removing water from the web WE through the heat conductive belt 26E. Alternatively, the heat conductive belt 26E may be a felt containing heat conductive filaments for conducting heat to the web WE and removing water therefrom.

Figure 7:
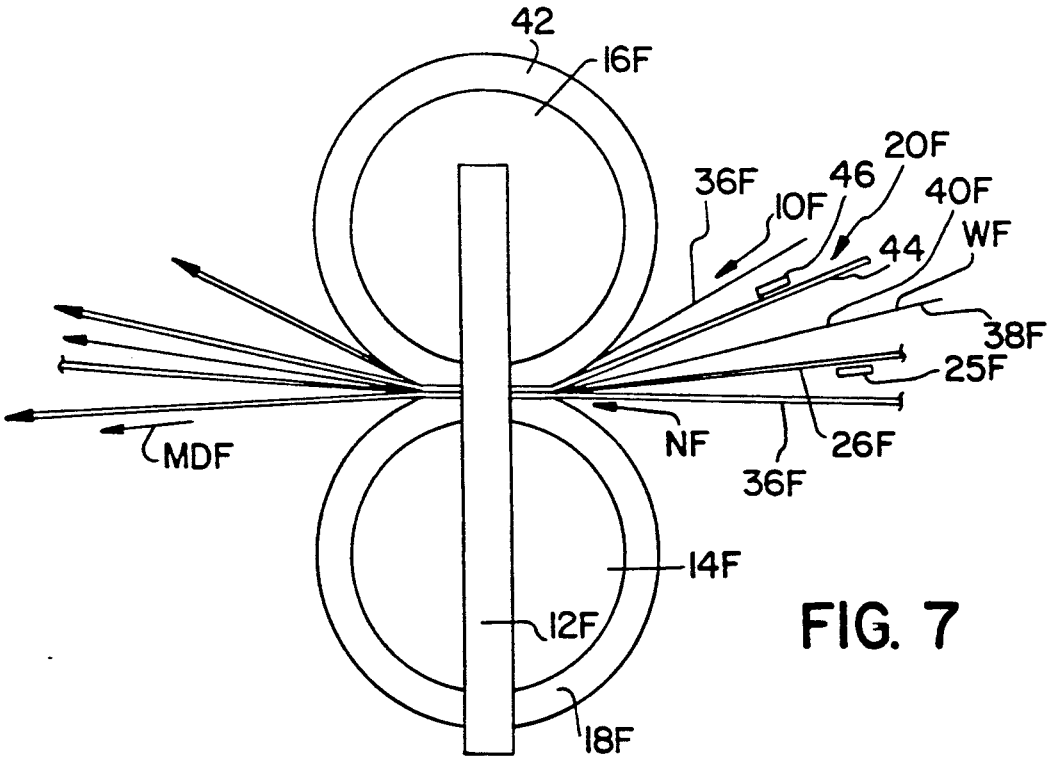
FIG. 7 is a side-elevational view of a seventh embodiment of the present invention.

FIG. 7 is an elevational view of another embodiment of the present invention in which a press apparatus generally designated 10F presses water from a paper web WF. The apparatus 10F includes a frame 12F and a first press roll 14F rotatably supported by the frame 12F.

A second press roll 16F cooperates with the first press roll 14F for defining therebetween a pressing nip NF such that in use of the apparatus 10F, the web WF extends through the nip NF for pressing water therefrom.

A first elastomeric cover 18F covers the first press roll 14F such that the pressing nip NF is extended in a machine direction, as indicated by the arrow MDF, so that the residence time of the web WF during passage of the web WF through the nip NF is increased.

A second elastomeric cover 42 covers the second press roll 16F such that the pressing nip NF is extended in a machine direction MDF so that the residence time of the web WF during passage of the web WF through the nip NF is increased.

Heating means generally designated 20F conducts heat to the web WF such that during movement of the web WF through the pressing nip NF, the web WF is subjected to increased temperature and pressure for an extended period such that a substantial portion of the water within the web WF is removed in the liquid phase.

More specifically, the heating means 20F includes, in combination, a first heat conductive belt 26F which defines an endless loop. The first belt 26F extends through the pressing nip NF such that heat is conducted from the first belt 26F to the web WF for heating a first side 38F of the web WF during movement of the web WF and the first belt 26F through the pressing nip NF.

A first heater 25F is disposed closely adjacent to the first belt 26F and upstream relative to the pressing nip NF for heating the first belt 26F.

A second heat conductive belt 44 defines an endless loop. The second belt 44 extends through the pressing nip NF such that heat is conducted from the second belt 44 to the web WF for heating a second side 40F of the web WF during movement of the web WF and the second belt 44 through the pressing nip NF. The web WF is disposed between the first and the second belts 26F and 44 respectively.

A second heater 46 is disposed closely adjacent to the second belt 44 and upstream relative to the pressing nip NF for heating the second belt 44.

At least one of the heated belts 26F and 44 are permeable such that water removed from the web is transported away from the nip NF by either one or both of the permeable belts 26F or 44.

In operation of the apparatus the web is moved through a pressing nip defined between a first and a second press roll rotatably supported by a frame. The first press roll is covered with an elastomeric cover and the second press roll defines a porous outer layer.

The porous outer layer of the second press roll is heated such that heat is conducted from the porous outer layer to the web during movement of the web through the pressing nip, the web being subjected to increased temperature and pressing for an extended period during movement of the web through the pressing nip such that a substantial portion of the water within the web is removed in the liquid phase. The water in the liquid phase and the water in the vapor phase are absorbed by the porous outer surface so that delamination of the resultant web is inhibited.

In operation of the embodiment shown in FIG. 2, the belt 26 is heated by the heater 25 so that the web WA is heated during movement through the nip NA.

In operation of the embodiment shown in FIG. 3, the blanket 28B and the web WB wrap around a portion 34 of the second roll 16B.

The operation of the arrangement shown in FIG. 4 is similar to that shown in FIG. 3. However, the web WC and blanket 28C are guided around the guide means 32C such that the blanket 28C and the web WC wrap around a portion 34C of the porous outer surface 22C.

In operation of the arrangement shown in FIG. 5, an insulating means 36 provides insulation for the elastomeric cover 18D.

The arrangement shown in FIG. 6 includes the combination of a heated belt 26E and an induction heater 24E so that both sides of the web WE are heated.

In operation of the arrangement shown in FIG. 7, both press rolls 14F and 16F include covers 18F and 42, respectively, and the web WF is heated on one side by heated belt 26F and on the other side thereof by heated belt 44.

It will be understood by those in the art that although the cover 18 of the press roll 14 is described as being concentric relative to the roll 14, the cover will not be concentric during passage thereof through the nip because the cover will be deformed during movement through the pressing nip.

The present invention provides a press apparatus which provides a pressing nip which is extended in a machine direction so that the residence time of the web during passage of the web through the pressing nip is increased, the extended pressing nip avoiding the complexity and attendant high costs involved in the provision of either a hydrodynamic or hydrostatic shoe of an extended nip press.

What is claimed is:

1. A press apparatus for pressing water from a paper web, said apparatus comprising:

a frame;

a first press roll rotatably supported by said frame;

a second press roll cooperating with said first press roll for defining therebetween a pressing nip such that in use of the apparatus, the web extends through said nip for pressing said water therefrom;

a felt extending through said nip for removing a substantial portion of water from the web;

an elastomeric cover covering said first press roll such that said pressing nip is extended in a machine direction so that the residence time of the web during passage of the web through said nip is increased;

said first press roll being covered with said elastomeric cover such that said cover is disposed concentrically relative to said first press roll; said first press roll having a larger diameter than said second press roll;

heating means for conducting heat to the web such that during movement of the web through said pressing nip, the web is subjected to increased temperature and pressure for an extended period such that a substantial portion of water within the web is removed in the liquid phase;

said second press roll defining a porous outer surface such that during use of the apparatus, said water in the liquid phase and said water in the vapor phase are absorbed by said porous outer surface so that delamination of the web is inhibited;

an elastomeric blanket defining an endless loop, said blanket extending through said pressing nip such that the web is disposed between said blanket and said second press roll such that said blanket further softens said pressing nip defined between said blanket and said second press roll so that said residence time of the web during passage of the web through the pressing nip is further increased; and guiding means disposed downstream relative to said pressing nip, said guiding means being disposed heater to said second press roll than to said first press roll such that said blanket and the web wrap around a portion of said porous outer surface of said second press roll downstream relative to said pressing nip so that adjustment of the pressure profile of the web exiting said pressing nip is controlled, the arrangement being such that any tendency of the web to delaminate is further alleviated, thus assisting dewatering of the web and facilitating release of the web from said porous outer surface of said press roll so that the properties of the resultant pressed web are enhanced.

2. A press apparatus as set forth in claim 1 wherein said heating means is disposed closely adjacent to said second press roll for heating said porous outer surface of said second press roll such that heat is conducted from said porous outer surface to the web during movement of the web through said pressing nip.

3. A press apparatus as set forth in claim 2 wherein said heating means is an induction heater.

4. A press apparatus as set forth in claim 2 wherein said heating means is a gas fired burner.

5. A press apparatus as set forth in claim 4 wherein said heating means is an electric infrared heater.

6. A press apparatus as set forth in claim 1 wherein said heating means includes:

a heat conductive belt which defines an endless loop, said belt extending through said pressing nip such that heat is conducted from said belt to the web during movement of the web and said belt through said pressing nip; and a heater disposed closely adjacent to said belt and upstream relative to said pressing nip for heating said belt.

7. A press apparatus as set forth in claim 6 wherein said heated belt is metallic.

8. A press apparatus as set forth in claim 7 wherein said metallic belt includes water absorbing fibers.

9. A press apparatus as set forth in claim 1 further including:

guide means disposed upstream relative to said pressing nip, said guide means being disposed nearer to said second press roll than to said first press roll such that said blanket and the web wrap around a portion of said porous outer surface of said second press roll upstream relative to said pressing nip so that adjustment of the pressure profile of the web entering said pressing nip is controlled, the arrangement being such that any tendency of the web to delaminate is further alleviated, thus assisting dewatering of the web and facilitating release of the web from said porous outer surface of said press roll so that the properties of the resultant pressed web are enhanced.

10. A press apparatus as set forth in claim 1 further including:

an insulating means, said insulating means extending through said pressing nip, said insulating means being disposed between said cover and said web for inhibiting the conduction of heat from said heating means to said elastomeric cover.

11. A press apparatus for pressing water from a paper web, said apparatus comprising:

a frame;

a first press roll rotatably supported by said frame;

a second press roll cooperating with said first press roll for defining therebetween a pressing nip such that in use of the apparatus, the web extends through said nip for pressing said water therefrom;

a first elastomeric cover covering said first press roll such that said pressing nip is extended in a machine direction so that the residence time of the web during passage of the web through said nip is increased;

a second elastomeric cover covering said second press roll such that said pressing nip is extended in a machine direction so that the residence time of the web during passage of the web through said nip is increased;

heating means for conducting heat to the web such that during movement of the web through said pressing nip, the web is subjected to increased temperature and pressure for an extended period such that a substantial portion of water within the web is removed in the liquid phase;

said heating means including:

a first heat conductive permeable belt which defines an endless loop, said first belt extending through said pressing nip such that heat is conducted from said first belt to the web for heating a first side of the web during movement of the web and said first belt through said pressing nip;

a first heater disposed closely adjacent to said first belt and upstream relative to said pressing nip for heating said first belt;

a second heat conductive belt defining an endless loop, said second belt extending through said pressing nip such that heat is conducted from said second belt to the web for heating a second side of the web during movement of the web and said second belt through said pressing nip, the web being disposed between said first and second belts; and a second heater disposed closely adjacent to said second belt and upstream relative to said pressing nip for heating said second belt.

* * * * *

UNITED STATES PATENT AND TRADEMARK OFFICE

CERTIFICATE OF CORRECTION

PATENT NO. : 5,131,983

DATED : July 21, 1992

INVENTOR(S) : Jeffrey H. Pulkowski; Robert J. Orange

It is certified that error appears in the above—identified patent and that said Letters Patent is hereby corrected as shown below:

Column 10, Line 37: Please delete "heater" and insert --nearer-- in place thereof.

Signed and Sealed this

Seventeenth Day of August, 1993

Bruce Lehman

*Attest:*

BRUCE LEHMAN

*Attesting Officer*

*Commissioner of Patents and Trademarks*